US011315507B2

(12) United States Patent
Zhang

(10) Patent No.: US 11,315,507 B2
(45) Date of Patent: Apr. 26, 2022

(54) DISPLAY PANEL HAVING COLUMN INVERSION POLARITY AND COMPENSATION VOLTAGE DRIVING METHOD

(71) Applicant: HKC CORPORATION LIMITED, Guangdong (CN)

(72) Inventor: Liang Zhang, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 17/264,297

(22) PCT Filed: Dec. 6, 2019

(86) PCT No.: PCT/CN2019/123607
§ 371 (c)(1),
(2) Date: Jan. 29, 2021

(87) PCT Pub. No.: WO2020/134964
PCT Pub. Date: Jul. 2, 2020

(65) Prior Publication Data

US 2021/0295790 A1 Sep. 23, 2021

(30) Foreign Application Priority Data

Dec. 24, 2018 (CN) ..... 201811587917.0

(51) Int. Cl.
*G09G 3/36* (2006.01)

(52) U.S. Cl.
CPC ..... *G09G 3/3614* (2013.01); *G09G 3/3648* (2013.01); *G09G 3/3696* (2013.01); *G09G 2300/0443* (2013.01)

(58) Field of Classification Search
CPC ..... G09G 3/3614
(Continued)

(56) References Cited

U.S. PATENT DOCUMENTS

2013/0215096 A1* 8/2013 Kim ..... G09G 3/3648 345/212
2015/0194107 A1* 7/2015 Bae ..... G09G 3/3688 345/696
2018/0059458 A1* 3/2018 Chen ..... G02F 1/133308

FOREIGN PATENT DOCUMENTS

CN 101029988 A 9/2007
CN 101577091 A 11/2009
(Continued)

OTHER PUBLICATIONS

First Office Action in counterpart Chinese Application No. 201811587917.0, dated Dec. 18, 2019.
(Continued)

*Primary Examiner* — Long D Pham

(57) ABSTRACT

A display panel control method, a display panel control device, and a display panel. The control method comprises: obtaining a first polarity of a drive voltage of a first pixel column, a second polarity of a drive voltage of a green pixel column, and a third polarity of a drive voltage of a third pixel column (S10); when the second polarity is opposite to the first polarity and the third polarity, determining a voltage compensation value of each of green sub-pixels according to a preset common voltage value and the current common voltage value (S30); and reducing the corresponding first voltage according to each of the voltage compensation values (S40).

20 Claims, 6 Drawing Sheets

(58) Field of Classification Search
USPC ..... 345/214
See application file for complete search history.

(56) References Cited

FOREIGN PATENT DOCUMENTS

| | | | |
|---|---|---|---|
| CN | 104090438 | A | 10/2014 |
| CN | 104157251 | A | 11/2014 |
| CN | 105047162 | A | 11/2015 |
| CN | 106205544 | A | 12/2016 |
| CN | 107464541 | A | 12/2017 |
| CN | 109712580 | A | 5/2019 |
| KR | 20130051773 | A | 5/2013 |

OTHER PUBLICATIONS

International Search Report in corresponding PCT Application No. PCT/CN2019/123607, dated Mar. 5, 2020.
Written Opinion of the International Searching Authority in corresponding PCT Application No. PCT/CN2019/123607, dated Mar. 5, 2020.

* cited by examiner

DISPLAY PANEL HAVING COLUMN INVERSION POLARITY AND COMPENSATION VOLTAGE DRIVING METHOD

CROSS REFERENCES TO RELATED APPLICATIONS

The present disclosure is the national stage of International Application No. PCT/CN2019/123607, filed Dec. 6, 2019, which claims priority to CN Application No. 201811587917.0, filed on Dec. 24, 2018, and entitled "DISPLAY PANEL CONTROL METHOD, DISPLAY PANEL CONTROL DEVICE AND DISPLAY PANEL", which is hereby incorporated by reference in its entirety.

FIELD

The disclosure relates to the technical field of display, in particular to a display panel control method, a display panel control device and a display panel.

BACKGROUND

The statements herein merely provide a background information related to the present disclosure and do not necessarily constitute prior art.

At present, in order to improve the display effect of the display panel, most display panels are driven by the voltages of opposite polarities to drive the pixel points to emit. However, the pixel electrode voltages of different polarities can pull the common electrode voltage at the same time. When the red, green and blue three-seed pixels are driven by different polarities, the polarity coupling of the green sub-pixels to the common electrode cannot counteract the polarity coupling of the red and blue sub-pixels to the common electrode, so that the voltage difference between the pixel electrode and the common electrode of the green sub-pixel becomes larger. In particular, in the display screen driven by column inversion, the sub-pixels of adjacent columns are driven by different polarities, the sensitivity of human eyes to green is greater than red and blue, and the green sub-pixels of each column are lightened, so that the whole picture of the screen seen by the user is green.

SUMMARY

The main purpose of the present disclosure is to provide a display panel control method, which aims to improve the display effect of a display screen.

In order to achieve the above purpose, the present disclosure provides a display panel control method applied to a display panel. The display panel includes a display array, and the display array includes a plurality of pixel groups arranged in a row direction. A pixel group includes a first pixel column, a green pixel column and a third pixel column which are sequentially arranged in the row direction, in particular the green pixel column includes a plurality of green sub-pixels arranged in a column direction, and a drive voltage corresponding to each green sub-pixel is defined as a first voltage; the display panel control method includes the following steps:

obtaining a first polarity of a drive voltage of the first pixel column, obtaining a second polarity of a drive voltage of the green pixel column; obtaining a third polarity of a drive voltage of the third pixel column;

in determining that the second polarity is opposite to the first polarity and the third polarity, obtaining a current common voltage value and a preset common voltage value of the display panel;

determining a voltage compensation value of each of the green sub-pixels according to the preset common voltage value and the current common voltage value; and, reducing the first voltage correspondingly according to the voltage compensation value.

The present disclosure provides a display panel control method, by sequentially arranging a first pixel column, a green pixel column and a third pixel column in the display panel, when the display panel is driven in a column inversion mode, a polarity of a drive voltage of the green pixel column is different from a polarity of drive voltages of the first pixel column and the third pixel column. A corresponding voltage compensation value is determined according to a current common voltage value and a preset common voltage value, and the drive voltage corresponding to each green sub-pixel is reduced according to the voltage compensation value. A pixel voltage corresponding to the green pixel column is prevented from being too large due to the polarity coupling generated by the first pixel column and the third pixel column to the common electrode, and the display effect of the display picture is improved.

Figure 1:
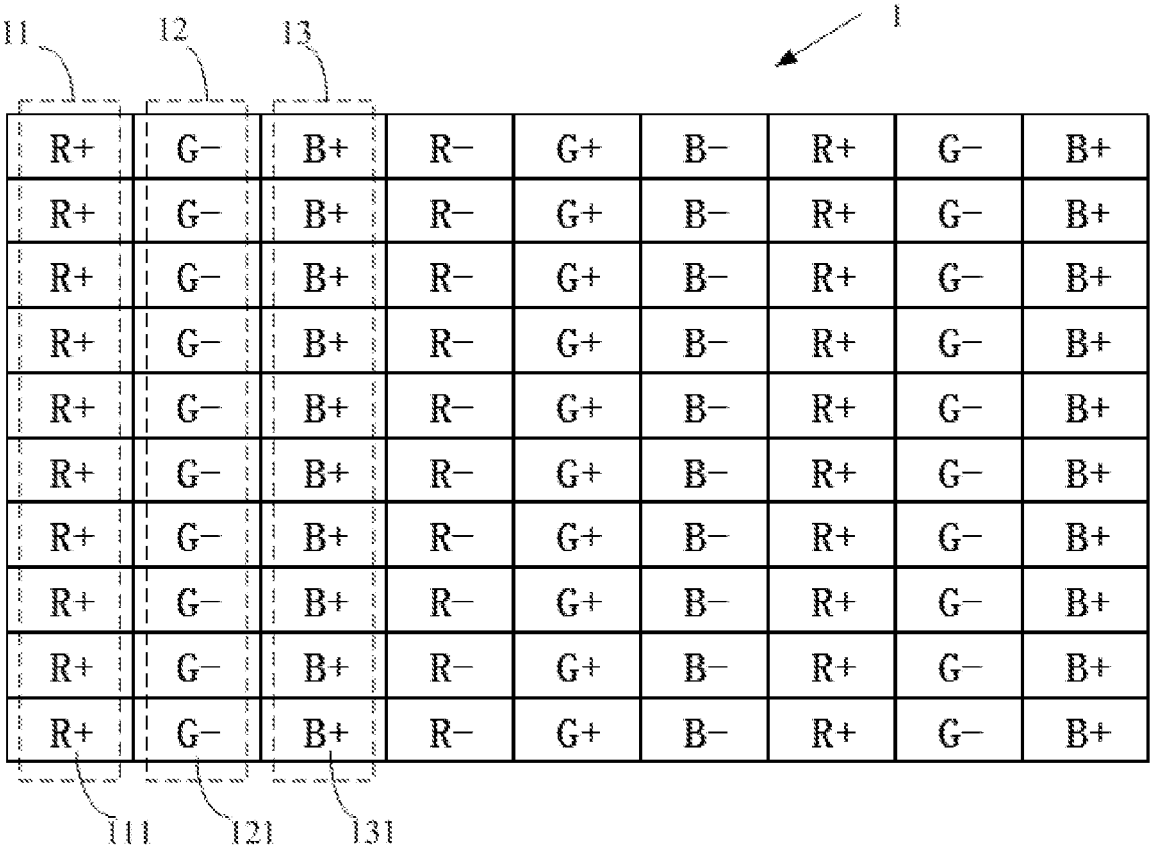
FIG. 1 is a schematic diagram of a display array arrangement structure in a display panel according to an embodiment of the present disclosure.

The implementation, the function features and the advantages of the present disclosure will be further explained with reference to the accompanying drawings.

DETAILED DESCRIPTION OF THE EMBODIMENTS

It should be understood that the specific embodiments described herein are used merely to explain the present disclosure and are not intended to limit the present disclosure.

The main solution of the embodiments of the present disclosure is that in a display panel, the display panel includes a display array 1, the display array 1 includes pixel groups arranged in a row direction, each of the pixel groups includes a first pixel column 11, a green pixel column 12 and a third pixel column 13 which are sequentially arranged in the row direction, the green pixel column 12 includes a plurality of green sub-pixels 121 arranged in a column direction, and a drive voltage corresponding to the green sub-pixel 121 is defined as a first voltage; based on the above display panel, a second polarity of a drive voltage of the green pixel column 12 is obtained by acquiring a first polarity of a drive voltage of the first pixel column 11; acquiring a third polarity of a drive voltage of the third pixel column 13; in determining that the second polarity is opposite to the first polarity and the second polarity is opposite to the third polarity, acquiring a current common voltage value and a preset common voltage value of the display panel; a voltage compensation value corresponding to each of the green sub-pixels 121 is determined according to the preset common voltage value and the current common voltage value; and the corresponding first voltage is reduced according to each of voltage compensation values.

In the picture displayed by the display panel driven by the column inversion, the pixel columns of different colors are driven by different polarities, the pixel voltages of the green sub-pixels 121 are higher due to the polarity coupling effect between the drive voltages of the sub-pixels and the common voltage, the sensitivity of the human eye to the green is greater than to the red and to the blue, the green sub-pixels 121 of the columns are bright, and a green range of the brightness is relatively concentrated, so that the overall green color of the screen seen by the user is caused.

According to the control method for the display panel, the phenomenon that the pixel voltage corresponding to the green pixel column 12 is too large due to the polarity coupling generated by the first pixel column 11 and the third pixel column 13 to the common electrode is avoided, the overall green color of the display screen is avoided and a display effect of the display screen is improved.

The disclosure provides a display panel. In particular, the display panel can include a liquid crystal display panel.

In the embodiment of the present disclosure, as shown in FIG. 1, the display panel includes a display array 1, a driver (not shown) and a display panel control device 3. The display array 1 includes a plurality of pixel groups arranged in a row direction. Each pixel group includes a first pixel column 11, a green pixel column 12 and a third pixel column 13 which are sequentially arranged in the row direction. The display panel control device 3 is connected to the driver (not shown) to control the operation of the driver (not shown). In the display array 1, different pixel groups are driven by the driver (not shown) to emit light of different colors and brightness so as to realize display of a current image frame.

The first pixel column 11 and the third pixel column 13 are pixel columns different from the green color. Specifically, the first pixel column 11 can be configured to be a red pixel column, and the third pixel column 13 can be configured to be a blue pixel column. The display array 1 is formed by the first pixel column 11, the green pixel column 12 and the third pixel column 13 which are sequentially arranged in the row direction. In addition to the first pixel column 11, the green pixel column 12, and the third pixel column 13, the display array 1 can further include pixel columns of other colors, the plurality of pixel groups formed by the pixel columns including the different colors of the green pixel column 12 are arranged in the row direction to form the display array 1, the row direction is the row direction of the display array 1, and the direction of the extension configuration of the pixel column is the column direction of the display array 1.

The drivers (not shown) are respectively connected with the first pixel column 11, the third pixel column 13 and the green pixel column 12, a control chip of the display panel generates corresponding gray scale data of each pixel column according to image data of a currently displayed image frame and sends the gray scale data to the driver (not shown), and the driver (not shown) respectively drives the first pixel column 11, the third pixel column 13 and the green pixel column 12 according to the gray scale data corresponding to each pixel column a voltage difference (pixel voltage) formed between the received drive voltage and the common voltage of each pixel column drives the light emitting factor (e.g., liquid crystal molecules) to deflect and emit light so as to realize image display.

In particular, when the first pixel column 11 is a red pixel column, the first pixel column 11 is driven by the driver (not shown) to emit red light; the green pixel column 12 is driven by the driver (not shown) to emit green light. When the third pixel column 13 is a blue pixel column, the third pixel column 13 is driven by the driver (not shown) to emit blue light. The driver (not shown) drives the first pixel column 11, the third pixel column 13, and the green pixel column 12 in a column inversion mode, the driver (not shown) drives the first pixel column 11 and the third pixel column 13 with the drive voltage of positive polarity, and the driver (not shown) drives the green pixel column 12 with the drive voltage of negative polarity.

In particular, the green pixel column 12 includes a plurality of green sub-pixels 121 arranged in the column direction, the first pixel column 11 includes a plurality of first sub-pixels 111 arranged in the column direction, and the third pixel column 13 includes a plurality of third sub-pixels 131 arranged in the column direction. The driver (not shown) is connected with the green sub-pixels 121, the first sub-pixels 111 and the third sub-pixels 131 through data lines.

Each green sub-pixel 121, each first sub-pixel 111, and each third sub-pixel 131 includes a thin-film transistor, and the driver (not shown) is respectively connected with a source of each thin-film transistor through a data line. The drive voltage (not shown) of the driver corresponding to each pixel column includes a sub-drive voltage value of each sub-pixel in each pixel column, the control chip of the display panel generates corresponding gray scale data of each sub-pixel according to the image data of the currently displayed image frame and sends the gray scale data to the driver (not shown), and the driver (not shown) drives the green sub-pixels 121, the first sub-pixels 111 and the third sub-pixels 131 respectively according to gray-scale data corresponding to each of the sub-pixels.

Figure 2:
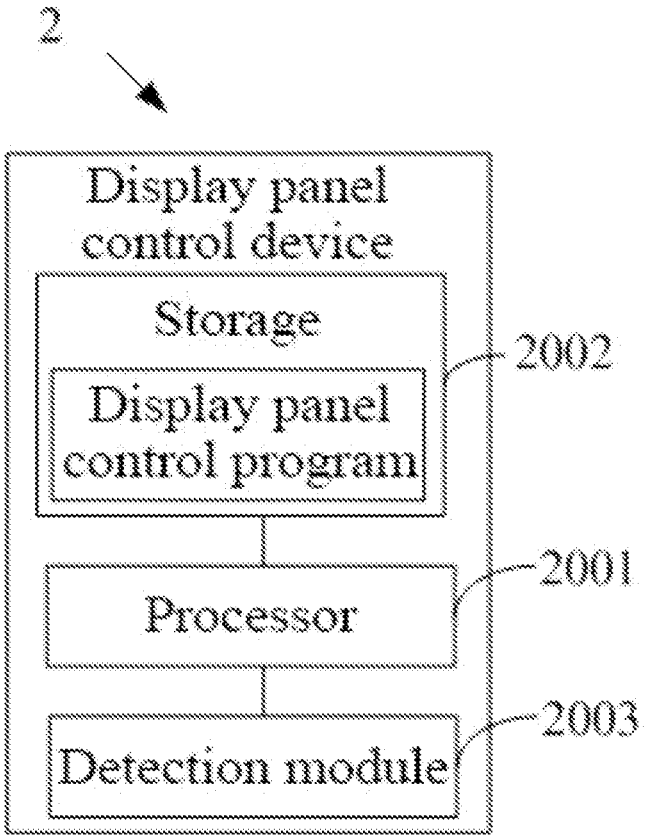
FIG. 2 is a hardware structure diagram of a display panel control device according to an embodiment of the present disclosure.

As shown in FIG. 2, the display panel control device 3 may include a processor 2001, such as a CPU, a memory 2002 and a detection module 2003. The processor 2001 is respectively connected with the memory 2002, the detection module 2003, the driver (not shown) and the like. The memory 2002 may be a high-speed RAM memory or a non-volatile memory, such as a disk storage. The memory 2002 may optionally further be a storage device independent of the processor 2001.

In particular, the detection module 2003 includes a first detector and a second detector, wherein the first detector is configured to detect a first polarity of a drive voltage of the first pixel column, detect a second polarity of a drive voltage of the green pixel column, and form a first detection data to be sent to the processor; and acquire a third polarity of a drive voltage of the third pixel column; the second detector is configured to detect a current common voltage value and a preset common voltage value of the display panel when the second polarity is opposite to the first polarity and the second polarity is opposite to the third polarity, and form a second detection data to be sent to the processor.

The memory 2002 includes a display panel control program stored in the memory 2002 and executable on the processor 2001, and further includes a voltage compensation value searching table or a compensation correction value searching table or the like.

The processor 2001 is configured to receive the first detection data and the second detection data, invoke and execute the display panel control program in the memory 2002 to implement the steps of a display panel control method in the following embodiments.

The detection module 2003 is connected to the driver (not shown) to detect a polarity and a voltage magnitude of a current voltage output by the driver (not shown) to each sub-pixel. In addition, the detection module 2003 is further connected to a common electrode in the display array to detect the current common voltage of the common electrode; in addition, the detection module 2003 is further connected to the processor 2001 to provide the first detection data and the second detection data to the processor 2001. The processor 2001 is connected to the driver (not shown) to output a voltage compensation value to the driver (not shown) so that the driver (not shown) adjusts the drive voltage output to the green sub-pixel according to the received voltage compensation value.

It will be appreciated by those skilled in the art that the structure shown in FIG. 2 does not constitute a definition of the device, the device may include more or fewer components than illustrated, or combine certain components, or have different component arrangements.

In the device shown in FIG. 2, the processor 2001 may be used to invoke the display panel control program stored in the memory 2002 and execute the steps of the following described display panel control method.

In addition, the embodiment of the disclosure further provides a readable storage medium. In particular, a display panel control program is stored in the readable storage medium, and the display panel control program is executed by the processor 2001 to perform the related steps of the display panel control method in the following embodiments.

Figure 3:
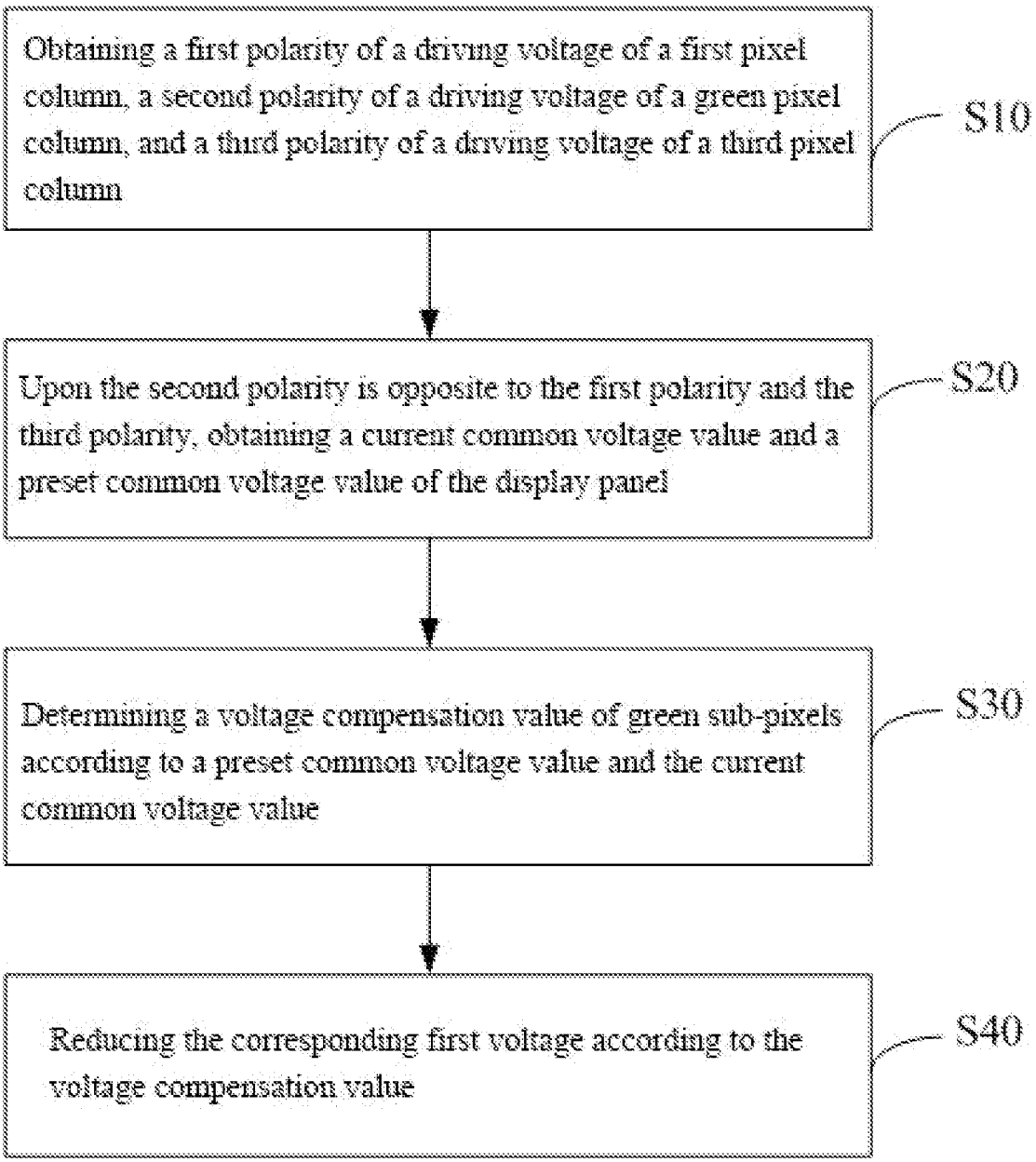
FIG. 3 is a flow diagram of a display panel control method according to an embodiment of the present disclosure.

According to FIG. 3, based on the display panel, a drive voltage corresponding to each of the green sub-pixels 121 is defined as a first voltage. The embodiment of the disclosure provides a display panel control method. The display panel control method includes the following steps:

Step S10, obtaining a first polarity of a drive voltage of the first pixel column 11, obtaining a second polarity of a drive voltage of the green pixel column 12; and obtaining a third polarity of a drive voltage of the third pixel column 13.

The drive voltage of the first pixel column 11 is the polarity drive voltage value generated by the driver (not shown) according to the gray scale data corresponding to each first sub-pixel 111 in the first pixel column 11; the drive voltage of the green pixel column 12 is the polarity drive voltage value generated by the driver (not shown) according to the gray scale data corresponding to each green sub-pixel 121 in the first pixel column 11; and the drive voltage of the third pixel column 13 is the polarity drive voltage value generated by the driver (not shown) according to the gray scale data corresponding to each third sub-pixel 131 in the third pixel column 13.

The first polarity, the second polarity, and the third polarity each specifically include a positive polarity or a negative polarity. The first polarity, the second polarity, and the third polarity are obtained after setting parameters of the driver (not shown) are acquired, or the first polarity, the second polarity, and the third polarity are obtained by capturing the output voltages of the first pixel column 11, the green pixel column 12 and the third pixel column 13 from the driver (not shown) and applying polarity testings on the output voltages, or the like.

Step S20, when the second polarity is opposite to the first polarity, and the second polarity is opposite to the third polarity, obtaining a current common voltage value and a preset common voltage value of the display panel.

When the green pixel column 12 and the first pixel column 11 are driven by the drive voltages of opposite polarities, and the green pixel column 12 and the third pixel column 13 are driven by the drive voltages of opposite polarities, it is indicated that the display panel is driven in a column inversion driving mode. For example, when the second polarity is negative, the first polarity and the third polarity are both positive, at this time, the current common voltage value and the preset common voltage value of the display panel can be obtained.

In particular, the current common voltage value is the actual voltage value of the common electrode detected by the detection module 2003. The preset common voltage value is a set voltage value assigned to the common electrode theoretically.

Step S30, determining a voltage compensation value corresponding to each green sub-pixel 121 according to the preset common voltage value and the current common voltage value.

The voltage compensation value is a voltage adjustment amplitude value that performs negative compensation on the drive voltage corresponding to each green sub-pixel 121.

The voltage compensation values corresponding to each green sub-pixel 121 can be the same, and can be determined according to a common voltage difference between the preset common voltage value and the current common voltage value. In particular, a corresponding relationship between a plurality of common voltage differences and a plurality of voltage compensation values is pre-established before the Step S10, and a voltage compensation value searching table is generated according to the corresponding relationship and stored in the memory 2002 to form a pre-stored voltage compensation value searching table. It should be noted that each pre-stored voltage compensation value in the pre-stored compensation value searching table is determined based on its corresponding common voltage difference and the coupling effect of different compensation voltages to the common voltage. In particular, different common voltage differences are used as the drive voltages of the green sub-pixel and the corresponding common voltage offset values are measured, and each voltage compensation value corresponding to each common voltage difference is determined according to the common voltage difference and the corresponding common voltage offset value so as to ensure the accuracy of the voltage compensation value. Step S30 may particularly include: determining a common voltage difference between the preset common voltage value and the current common voltage value; and determining a voltage compensation value of each green sub-pixel by searching in the pre-stored voltage compensation value searching table according to the common voltage difference. In particular, absolute values of the common voltage differences are the same, and the corresponding voltage compensation values are the same. In a pre-stored voltage compensation value searching table, a pre-stored common voltage difference consistent with the common voltage difference is inquired, and the pre-stored voltage compensation value corresponding to the pre-stored common voltage difference in the searching table is taken as the voltage compensation value of the drive voltage of each current green sub-pixel.

In addition, since the drive voltages corresponding to the green sub-pixels 121 are different, the polarity coupling effects on the common electrode are different, the voltage compensation values corresponding to the green sub-pixels 121 can be different with more accurate determined voltage compensation values. In particular, a voltage compensation value corresponding to each green sub-pixel 121 can be determined according to the first voltage, the preset common voltage value and the current common voltage value.

Step S40, reducing the corresponding first voltages according to the voltage compensation values respectively.

The display panel control device 3 sends each voltage compensation value to the driver (not shown), and the driver (not shown) correspondingly reduces the first voltage output to each green sub-pixel 121 according to the voltage compensation value.

In the display panel where the first pixel column 11, the green pixel column 12 and the third pixel column 13 are arranged in sequence, when the display panel is driven in a column inversion mode, and the polarity of the drive voltage of the green pixel column 12 is different to the polarities of the drive voltages of the first pixel column 11 and the third pixel column 13, by determining a corresponding voltage compensation value according to the current common voltage value and the preset common voltage value, and reducing the drive voltage corresponding to each green sub-pixel 121 according to the voltage compensation value, the display panel control method provided by the embodiments of the disclosure prevents the pixel voltage corresponding to the green pixel column 12 from being too large due to the polarity coupling generated by the first pixel column 11 and the third pixel column 13 to the common electrode, and improves the display effect of the display screen.

Further, based on the embodiment shown in FIG. 3, when the second polarity is opposite to the first polarity, and the second polarity is opposite to the third polarity, before the step of obtaining a current common voltage value and a preset common voltage value of the display panel, a step of obtaining an image gray scale of the current display image frame in real time is also included. In determining that the image gray scale is less than or equal to a preset value, the step of acquiring a current common voltage value and a preset common voltage value of the display panel is executed.

The image gray scale of the current display image frame is calculated according to a pixel gray scale corresponding to each sub-pixel in the display image frame, and the image gray scale is a gray scale value represents an overall brightness of the current display image frame.

When the second polarity is opposite to the first polarity and the third polarity, an image gray scale of the current display image frame is obtained. Whether the obtained image gray scale is less than or equal to a preset value is judged. In determining that the image gray scale is less than or equal to the preset value, it is indicated that the current display image frame is a low-gray-scale image, and at the moment, the current common voltage value and the preset common voltage value of the display panel can be acquired, and the steps S30 and S40 are sequentially executed to adjust the drive voltages corresponding to the green sub-pixels 121.

In the present embodiment, since an overall brightness of the display screen is large with a high-gray-scale image, the green pixel column 12 is not easily perceptible to the naked eye even if the brightness of the green pixel column 1 is too bright. However, with a low-gray-scale image, the overall brightness of the display image is low, the common voltage offset caused by the polarity coupling causing the green pixel column 12 to be highlighted in the low-gray-scale image is especially obvious, and in the low-gray-scale image, the human eye is easier to perceive the green color of the display image which is reversely driven by the display column. Therefore, by means of the above method, it is beneficial to ensure that the green phenomenon does not occur when the low-gray-order image is displayed, and the picture display quality of the display panel is improved.

Figure 4:
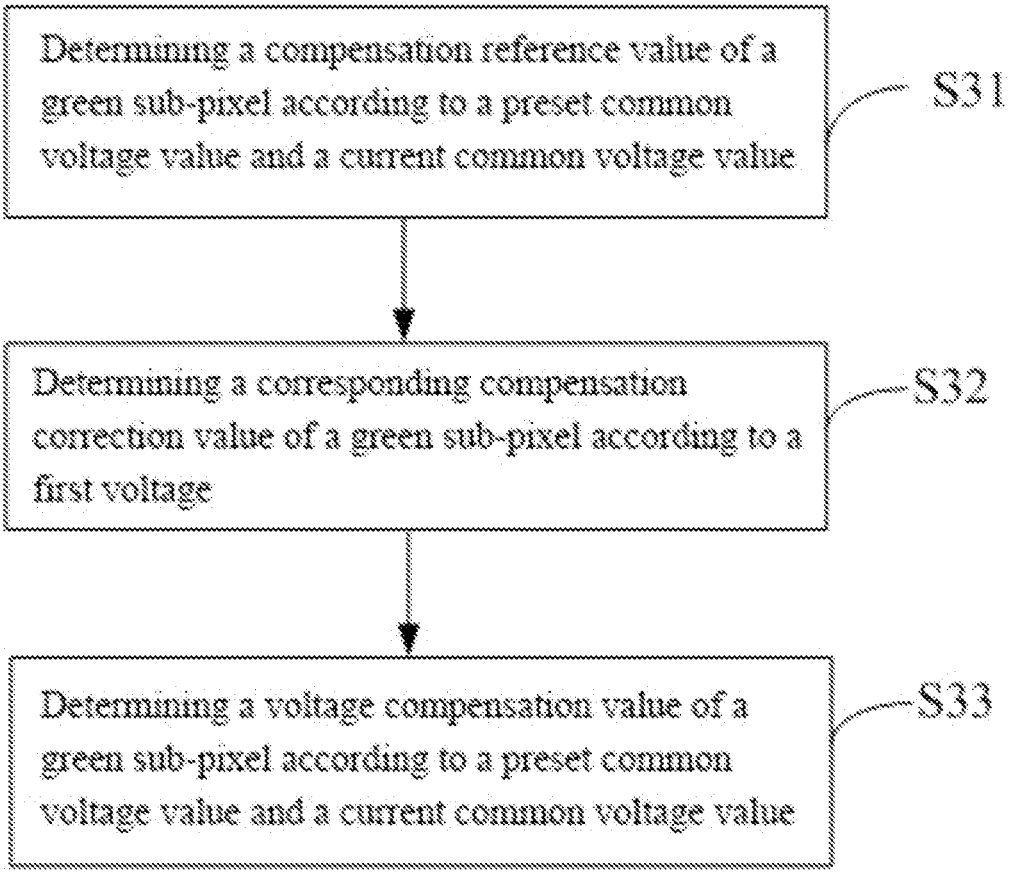
FIG. 4 is a flow diagram of a display panel control method according to another embodiment of the present disclosure.

Further, based on the above embodiments, referring to FIG. 4, the step of determining a voltage compensation value corresponding to each green sub-pixel 121 according to the preset common voltage value and the current common voltage value includes:

Step S31, determining a compensation reference value of each green sub-pixel 121 according to the preset common voltage value and the current common voltage value.

In particular, the voltage difference between the preset common voltage value and the current common voltage value is determined, and the compensation reference value is determined according to the determined voltage difference. It is noted that if absolute values of the voltage difference are the same, the corresponding compensation reference values are the same. For example, the voltage difference of the preset common voltage value and the current common voltage value can be directly used as the compensation reference value of each green sub-pixel 121; or, after the voltage difference of the preset common voltage value and the current common voltage value is obtained, the compensation reference value corresponding to each green sub-pixel 121 is calculated according to the obtained voltage difference and a preset adjustment coefficient. It is noted that the compensation reference value here is a reference value of adjusting amplitude of the drive voltage of each green sub-pixel, and is a value greater than 0.

Step S32, determining a compensation correction value corresponding to each green sub-pixel 121 according to the first voltage.

Different first voltages may correspond to different compensation correction values for green sub-pixels 121. In particular, the first voltage can be divided into a plurality of voltage ranges, different voltage ranges are correspondingly provided with different compensation correction values of green sub-pixels 121, and the compensation correction value corresponding to each green sub-pixel 121 can be determined according to the determined voltage range.

In addition, a preset relationship between the first voltages and the corresponding compensation correction values can be established, and a compensation correction value corresponding to each green sub-pixel 121 is calculated according to a first voltage and the preset relationship of the green sub-pixel 121. It is noted that the compensation correction values here are correction values of adjusting amplitude of the drive voltage of each green sub-pixel, and is a value greater than 0.

Step S33, determining the voltage compensation value corresponding to each green sub-pixel 121 according to the compensation reference value and the compensation correction value.

A difference between the compensation reference value and the compensation correction value corresponding to each green sub-pixel 121 is used as the voltage compensation value corresponding to the green sub-pixel 121. In particular, the larger the first voltage is, the larger the corresponding compensation correction value will be. That is, the larger the first voltage is, the smaller the corresponding voltage compensation value will be.

In the embodiment, since the larger the first voltage is, the smaller the influence of the polarity coupling effect of the common electrode, so that the voltage compensation value corresponding to each green sub-pixel 121 can be determined by combining the first voltage and the current common voltage value and the preset common voltage value, thus, the voltage compensation value can be adjusted and adapted to different first voltage, and the green phenomenon is avoided and the display effect required by the display screen is ensured.

Further, the first pixel column 11 includes a plurality of first sub-pixels 111 arranged in the column direction, the third pixel column 13 includes a plurality of third sub-pixels 131 arranged in the column direction. A drive voltage corresponding to the first sub-pixel 111 adjacent to the green sub-pixel 121 is defined as a second voltage, and a drive voltage corresponding to the third sub-pixel 131 adjacent to the green sub-pixel 121 is defined as a third voltage. Based on the embodiment of FIG. 4, the step of determining a compensation correction value corresponding to each green sub-pixel 121 according to the first voltage includes:

Step S330, determining the compensation correction value corresponding to each green sub-pixel 121 according to the first voltage and the corresponding second voltage and the third voltage.

Figure 5:
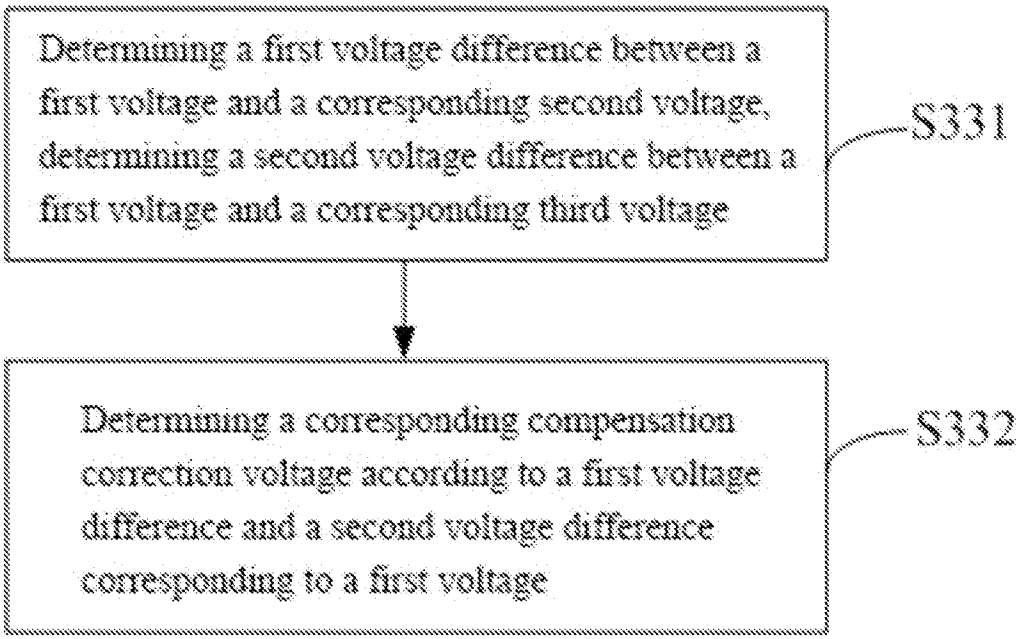
FIG. 5 is a flow diagram of a display panel control method according to still another embodiment of the present disclosure.

In particular, referring to FIG. 5, the Step S330 includes the following steps:

Step S331, determining a first voltage difference between each first voltage and the corresponding second voltage, and a second voltage difference between each first voltage and the corresponding third voltage;

Step S332, determining the compensation correction value corresponding to each green sub-pixel 121 according to the first voltage difference and the second voltage difference corresponding to each first voltage.

In particular, a corresponding relationship between first voltage differences, second voltage differences and corresponding compensation correction values can be established, and the corresponding relationship can particularly be a formula or a table, or the like. By establishing a preset formula, the compensation correction value corresponding to each green sub-pixel 121 can be calculated according to corresponding first voltage difference and second voltage difference.

The first voltage differences can be used as a row in a compensation correction value searching table, and the second voltage differences can be used as a column in the compensation correction value searching table, the preset compensation correction values corresponding to the first voltage differences and the second voltage differences can be used as values in the table, and after the corresponding first voltage difference and second voltage difference are determined, the preset compensation correction value as the compensation correction value corresponding to each green sub-pixel 121 is obtained through inquiring the compensation correction value searching table. It is noted that if absolute values of the first voltage differences and the second voltage differences are both the same, the corresponding compensation correction values are the same.

In addition, a first preset weight can further be set corresponding to the first voltage difference, a second preset weight can be correspondingly set for the second voltage difference, and a comprehensive difference is obtained through a weighted average calculation according to the first voltage difference and the corresponding first preset weight, the second voltage difference and the corresponding second preset weight. Different comprehensive differences may correspond to different compensation correction values. By calculating the comprehensive difference, the compensation correction value corresponding to each green sub-pixel 121 can be obtained. In particular, there are a plurality of difference ranges for comprehensive differences, and a comprehensive difference falls in different difference ranges corresponding to different compensation correction values.

In particular, the larger the first voltage difference and the second voltage difference are, the smaller the corresponding compensation correction value will be. Conversely, the smaller the first voltage difference and the second voltage difference are, the larger the corresponding compensation correction value will be.

In addition to the Steps S331 and S332, the corresponding relationship between the first voltage, the second voltage, the third voltage and the corresponding compensation correction value can be directly established. For example, the compensation correction value $V0=XV1+YV2+ZV3$, where $V1$ is the first voltage, $V2$ is the second voltage, $V3$ is the third voltage, X, Y and Z are preset coefficients, and the compensation correction value corresponding to each green sub-pixel 121 is directly calculated through the above formula.

In the embodiment, whether the green sub-pixels 121 seen by the human eye to be greener are affected by the brightness of the adjacent sub-pixels. If the brightness of the adjacent sub-pixels is large, the green sub-pixels are not easily perceived to be greener, and if the brightness of the adjacent sub-pixels is small, the green sub-pixels are easy to perceive to be greener. In order to make the adjustment of the drive voltage corresponding to each green sub-pixel 121 more accurate, the compensation correction value corresponding to the green sub-pixel 121 is determined by combining the first voltage, the second voltage and the third voltage, so that the corresponding drive voltage of the green sub-pixel 121 can be accurately adjusted, and the display quality of the display screen is further improved as well as avoiding the picture to be greener.

In particular, the first voltage difference and the second voltage difference can represent relative differences of brightness between the green sub-pixel 121 and the adjacent first sub-pixel 111 and the third sub-pixel 131 respectively. The relative difference is larger, the easier the human eye perceives the green phenomenon, and the smaller the corresponding compensation correction value will be, thus the voltage compensation value will be larger and closer to the compensation reference value, ensuring that the display screen does not have a green phenomenon. When the relative difference is smaller, the harder the human eye perceives the green phenomenon, and the larger the corresponding compensation correction value will be, thus the voltage compensation value will be smaller, ensuring that the displayed picture is closer to the display effect required by the current image frame while the display screen does not generate a green phenomenon.

Figure 6:
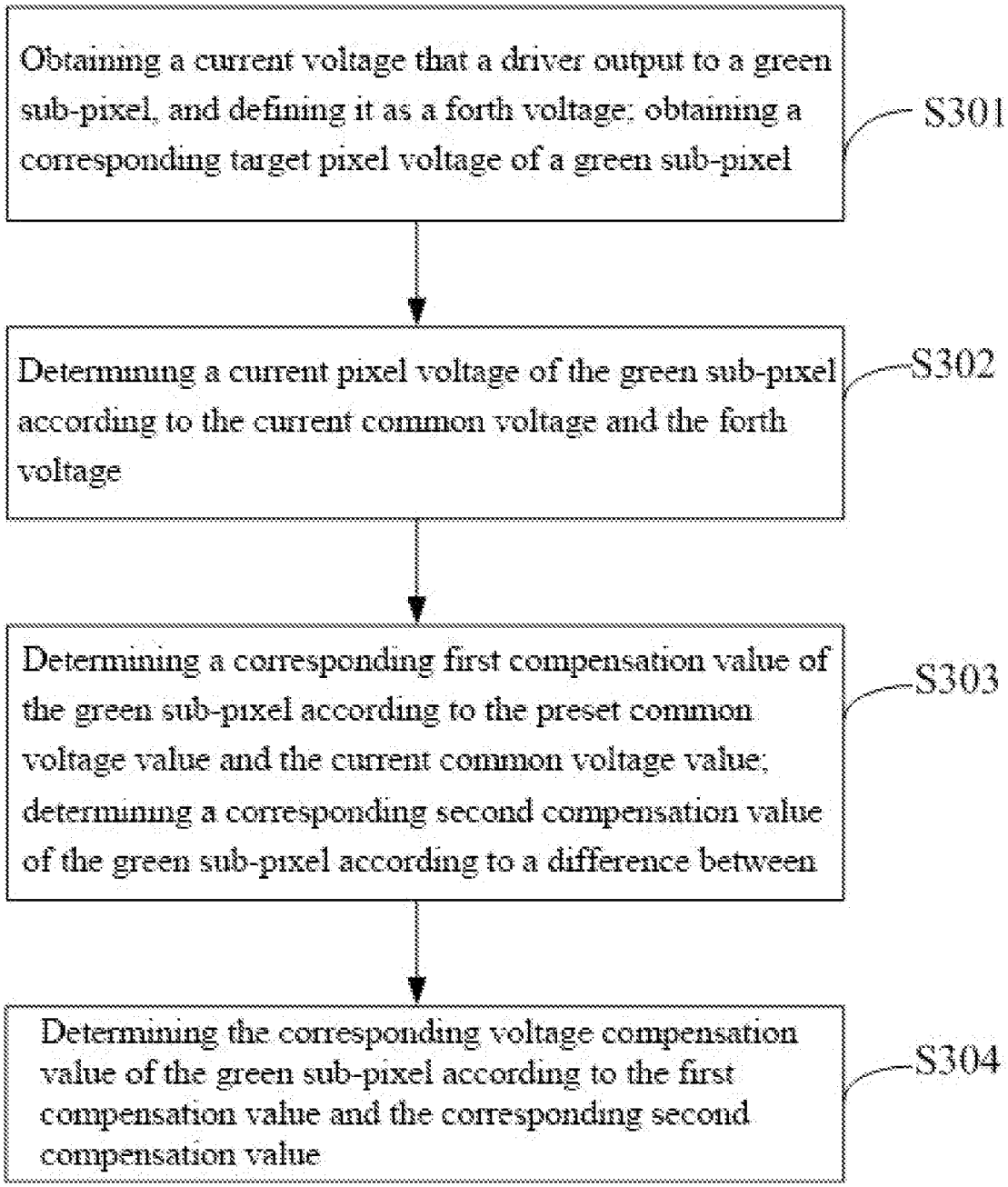
FIG. 6 is a flow diagram of a display panel control method according to still another embodiment of the present disclosure.

Further, the display panel further includes a driver (not shown), the driver (not shown) is configured to drive the green sub-pixels 121 according to the corresponding first voltages. Based on the above embodiments, referring to FIG. 6, the step of determining a voltage compensation value corresponding to each green sub-pixel 121 according to the preset common voltage value and the current common voltage value includes:

Step 301, obtaining a current voltage outputted by the driver (not shown) to each green sub-pixel 121 defining the current voltage as a fourth voltage; and obtaining a target pixel voltage corresponding to each green sub-pixel 121;

The fourth voltage is an actual voltage value that the driver (not shown) output to each green sub-pixel 121. The target pixel voltage is a theoretical value of the pixel voltage corresponding to each green sub-pixel 121 and determined according to the image data of the current image frame. After the display panel control device 3 determines the target pixel voltage corresponding to each green sub-pixel 121 according to the image data of the current image frame, the drive voltage (equivalent to the first voltage) corresponding to each green sub-pixel 121 can be determined according to the target pixel voltage and the preset common voltage value corresponding to the green sub-pixel 121.

Step 302, determining a current pixel voltage of each green sub-pixel 121 according to the current common voltage and the fourth voltage;

Step 303, determining a first compensation value corresponding to each green sub-pixel 121 according to the preset common voltage value and the current common voltage value; and determining a second compensation value corresponding to each green sub-pixel 121 according to a difference value of the target pixel voltage and the current pixel voltage of the green sub-pixel 121;

The voltage compensation value determined according to the preset common voltage value and the current common voltage value in the above embodiment is taken as the first compensation value.

Due to the loss of the data line or the voltage coupling between adjacent data lines, there exists deviation between the fourth voltage that the driver (not shown) actually outputs to each green sub-pixel 121 and the first voltage of the green sub-pixel 121. In addition, due to the polarity offset of the common voltage, the difference between the current pixel voltage and the target pixel voltage of each green sub-pixel 121 causes distortion of the pixel voltage. Therefore, the difference between the differences between the target pixel voltages and the current pixel voltages correspond to different second compensation values of the drive voltage, so as to reduce the influence of pixel voltage distortion on the display screen effect.

Step 304, determining the voltage compensation value corresponding to each green sub-pixel 121 according to the first compensation value and the corresponding second compensation value.

In particular, a sum of the first compensation value and the second compensation value corresponding to each green sub-pixel 121 is defined as the voltage compensation value corresponding to the green sub-pixel 121.

In the embodiment, the voltage compensation value corresponding to the green sub-pixel 121 is determined in the above manner, so that the influence of signal distortion on the display picture is reduced while the green phenomenon is avoided, and the display effect of the display screen is further improved.

It is noted that, herein, the terms "comprising", "including" or any other variation thereof, are intended to cover a non-exclusive inclusion, such that a process, method, article, or system that includes a series of elements not only includes those elements but also includes other elements not expressly listed, or that is an element inherent to such process, method, article, or system. In the absence of more constraints, an element defined by the statement "includes one . . . " does not preclude the presence of additional identical elements in the process, method, article, or system that includes the element.

The serial numbers of the embodiments of the present disclosure are described merely for the purpose of description and do not represent the disadvantages of the embodiments.

Through the description of the embodiments above, it will be clear to those skilled in the current existing technologies that the above-described embodiments can be realized by means of a software-plus-necessary general-purpose hardware platform, although, of course, it can be implemented in hardware, but in many cases the former is better. Based on such an understanding, the technical solutions of the present disclosure may be embodied in the form of a software product that is stored in a storage medium (e.g., ROM, RAM, magnetic disk, optical disk) as described above, including several instructions for causing a terminal device (which may be a cell phone, a computer, a server, an air conditioner, or a network device, etc.) to perform the method of various embodiments of the present disclosure.

The above is merely an alternative embodiment of the present disclosure, and is not intended to limit the patent scope of the present disclosure. Any equivalent structure or equivalent process transformation made by using the description of the present disclosure and the accompanying drawings, or application in other related technical fields either directly or indirectly, are all included in the patent protection scope of the present disclosure.

The invention claimed is:

1. A display panel control method applied to a display panel, the display panel comprising a display array, the display array comprising a plurality of pixel groups arranged along a row direction, the pixel groups comprising a first pixel column, a green pixel column, and a third pixel column sequentially arranged along the row direction, the green pixel array comprising a plurality of green sub-pixels arranged along a column direction, defining a drive voltage corresponding to each of the green sub-pixels as a first voltage, the display panel control method comprising the following steps:

obtaining a first polarity of a drive voltage of the first pixel column, a second polarity of a drive voltage of the green pixel column, and a third polarity of a drive voltage of the third pixel column;

in determining that the second polarity is opposite to the first polarity and the third polarity, obtaining a current common voltage value and a preset common voltage value of the display panel;

determining a voltage compensation value of each of the green sub-pixels according to the preset common voltage value and the current common voltage value; and reducing the first voltage correspondingly according to the voltage compensation value.

2. The display panel control method of claim 1, wherein, the second polarity is a negative polarity, the first polarity and the third polarity are positive polarities.

3. The display panel control method of claim 1, wherein, the step of reducing the first voltage correspondingly according to the voltage compensation value comprises:

sending the voltage compensation value to a driver, and driving the driver to reduce the first voltage of each of the green sub-pixels according to the voltage compensation value.

4. The display panel control method of claim 1, wherein, before the step of in determining that the first polarity is opposite to the second polarity and the third polarity, obtaining a current common voltage value and a preset common voltage value of the display panel, the method further comprises:

obtaining an image gray scale of a current display image frame in real time; and, in determining that the image gray scale is not larger than or equal to a preset value, executing the step of obtaining a current common voltage value and a preset common voltage value of the display panel.

5. The display panel control method of claim 4, wherein, the step of determining a voltage compensation value of each of the green sub-pixels according to the preset common voltage value and the current common voltage value comprises:

determining the voltage compensation value of each of the green sub-pixels according to the first voltage, the preset common voltage value and the current common voltage value.

6. The display panel control method of claim 5, wherein, the step of determining the voltage compensation value of each of the green sub-pixels according to the first voltage, the preset common voltage value and the current common voltage value comprises:

determining a compensation reference value of each of the green sub-pixels according to the preset common voltage value and the current common voltage value;

determining a compensation correction value of each of the green sub-pixels according to the first voltage; and determining the voltage compensation value of each of the green sub-pixels according to the compensation reference value and the compensation correction value.

7. The display panel control method of claim 6, wherein, the step of determining a compensation reference value of each of the green sub-pixel according to the preset common voltage value and the current common voltage value comprising:

determining a voltage difference between the preset common voltage value and the current common voltage value; and determining the compensation reference value according to the voltage difference.

8. The display panel control method of claim 7, wherein, absolute values of voltage differences are the same, corresponding compensation reference values are the same.

9. The display panel control method of claim 6, wherein, the step of determining a compensation correction value of each of the green sub-pixels according to the first voltage comprising:

determining a voltage range of the first voltage; and determining the compensation correction value of each of the green sub-pixels according to the voltage range.

10. The display panel control method of claim 6, wherein, the first pixel column comprising a plurality of first sub-pixels arranged along the column direction, the third pixel column comprising a plurality of third sub-pixels arranged along the column direction; defining a drive voltage corresponding to a first sub-pixel adjacent to a green sub-pixel as a second voltage, defining a drive voltage corresponding to a third sub-pixel adjacent to the green sub-pixel as a third voltage; the step of determining a compensation correction value of each of the green sub-pixels according to the first voltage comprises:

determining the compensation correction value of each of the green sub-pixels according to the first voltage, and the second voltage and the third voltage corresponding to the first voltage.

11. The display panel control method of claim 10, wherein, the step of determining the compensation correction value of each of the green sub-pixels according to the first voltage, and the second voltage and the third voltage corresponding to the first voltage comprises:

determining a first voltage difference between the first voltage and the second voltage corresponding to the first voltage, and determining a second voltage difference between the first voltage and the third voltage corresponding to the first voltage; and determining the compensation correction value according to the first voltage difference and the second voltage difference corresponding to the first voltage.

12. The display panel control method of claim 11, wherein, the step of determining the compensation correction value of each of the green sub-pixels according to the first voltage difference and the second voltage difference corresponding to the first voltage comprising:

determining the compensation correction value of each of the green sub-pixels by inquiring a compensation correction value searching table according to the first voltage difference and second voltage difference corresponding to the first voltage.

13. The display panel control method of claim 11, wherein, the step of determining the compensation correction value of each of the green sub-pixels according to the first voltage difference and the second voltage difference corresponding to the first voltage comprises:

obtaining a corresponding comprehensive difference of each of the green sub-pixels through a weighted average calculation according to the first voltage difference and a corresponding first preset weight, and the second voltage difference and a corresponding second preset weight; and, determining the compensation correction value of each of the green sub-pixels according to the corresponding comprehensive difference.

14. The display panel control method of claim 1, wherein, the display panel further comprises a driver configured to correspondingly drive each of the green sub-pixels according to the first voltage correspondingly, the step of determining a voltage compensation value of each of the green sub-pixels according to the preset common voltage value and the current common voltage value comprises:

obtaining a current voltage that the driver output to each of the green sub-pixels, and defining the current voltage as a fourth voltage; and obtaining a corresponding target pixel voltage of each of the green sub-pixels;

determining a current pixel voltage of each of the green sub-pixels according to the current common voltage value and the fourth voltage;

determining a first compensation value of each of the green sub-pixels according to the preset common voltage value and the current common voltage value; determining a second compensation value of each of the green sub-pixels according to a difference between a target pixel voltage and the current pixel voltage of the green sub-pixel; and, determining the voltage compensation value of each of the green sub-pixel according to the first compensation value and the second compensation value corresponding to the green sub-pixel.

15. The display panel control method of claim 1, wherein, the steps of determining a voltage compensation value of each of the green sub-pixels according to the preset common voltage value and the current common voltage value comprises:

determining a common voltage difference between the preset common voltage value and the current common voltage value; and, determining the voltage compensation value of each of the green sub-pixels by inquiring a pre-stored voltage compensation value searching table according to the common voltage difference.

16. The display panel control method of claim 15, wherein, the step of determining the voltage compensation value of each of the green sub-pixels by inquiring a pre-stored voltage compensation value searching table according to the common voltage difference comprises:

inquiring a pre-stored common voltage difference the same with the common voltage difference in the pre-stored voltage compensation searching table; and, taking a pre-stored voltage compensation value corresponding to the pre-stored common voltage difference in the pre-stored voltage compensation searching table as the voltage compensation value of the drive voltage of each of the green sub-pixels.

17. The display panel control method of claim 15, wherein, before the step of obtaining a first polarity of a drive voltage of the first pixel column, a second polarity of a drive voltage of the green pixel column, and a third polarity of a drive voltage of the third pixel column, the method further comprises:

pre-establishing a corresponding relationship between a plurality of common voltage differences and voltage compensation values; and generating the pre-stored voltage compensation value searching table according to the corresponding relationship.

18. The display panel control method of claim 17, wherein, the step of pre-establishing a corresponding relationship between a plurality of common voltage differences and voltage compensation values comprising:

taking the common voltage differences as drive voltages of the green sub-pixels respectively, and obtaining corresponding common voltage deviation values correspondingly; and, determining voltage compensation values corresponding to the common voltage differences according to the common voltage differences and the corresponding common voltage deviation values.

19. A display panel control device comprising:

a detecting module, comprising:

a first detector configured for detecting a first polarity of a drive voltage of a first pixel column and a second polarity of a drive voltage of a green pixel column, generating a first detection data sent to a processor; and obtaining a third polarity of a drive voltage of a third pixel column; and a second detector configured for detecting a current common voltage value and a preset common voltage value of the display panel in determining that the second polarity is opposite to the first polarity and the third polarity, and generating a second detection data sent to the processor;

a storage storing a display panel control program that is configured to be performed on the processor;

the processor configured for receiving the first detection data and the second detection data, to invoke and execute the display panel control program, to realize the following steps of a display panel control method:

obtaining the first polarity of the drive voltage of the first pixel column, the second polarity of the drive voltage of the green pixel column, and the third polarity of the drive voltage of the third pixel column;

in determining that the second polarity is opposite to the first polarity and the third polarity, obtaining a current common voltage value and a preset common voltage value of the display panel;

determining a voltage compensation value of each of the green sub-pixels according to the preset common voltage value and the current common voltage value; and reducing the first voltage correspondingly according to the voltage compensation value.

20. A display panel comprising:

a display array comprising a plurality of pixel groups arranged along a row direction, the pixel groups comprising a first pixel column, a green pixel column, and a third pixel column sequentially arranged along the row direction, the green pixel array comprising a plurality of green sub-pixels arranged along a column direction;

a driver connected with a detection module of a display panel control device and a processor, respectively connected with the green sub-pixels, first sub-pixels of the first pixel column and third sub-pixels of the third pixel column through a data bus; and, a display panel control device comprising:

a detecting module comprising:

a first detector configured for detecting a first polarity of a drive voltage of the first pixel column and a second polarity of a drive voltage of the green pixel column, and generating a first detection data sent to a processor; and obtaining a third polarity of a drive voltage of a third pixel column; and a second detector configured for detecting a current common voltage value and a preset common voltage value of the display panel in determining that the second polarity is opposite to the first polarity and the third polarity, and generating a second detection data sent to the processor;

a storage storing a display panel control program that is configured to be performed on the processor;

the processor configured for receiving the first detection data and the second detection data, to invoke and execute the display panel control program, to realize the following steps of a display panel control method:

obtaining the first polarity of the drive voltage of the first pixel column, the second polarity of the drive voltage of the green pixel column, and the third polarity of the drive voltage of the third pixel column;

in determining that the second polarity is opposite to the first polarity and the third polarity, obtaining a current common voltage value and a preset common voltage value of the display panel;

determining a voltage compensation value of each of the green sub-pixels according to the preset common voltage value and the current common voltage value; and reducing the first voltage correspondingly according to the voltage compensation value.

* * * * *